United States Patent [19]

Michelfelder

[11] 4,331,638

[45] May 25, 1982

[54] METHOD OF DRY SCRUBBING REACTION PRODUCTS RESULTING FROM FLAME BURNING

[75] Inventor: Sigfrid Michelfelder, Gummersbach, Fed. Rep. of Germany

[73] Assignee: L. & C. Steinmüller GmbH, Gummersbach, Fed. Rep. of Germany

[21] Appl. No.: 176,187

[22] Filed: Aug. 7, 1980

[30] Foreign Application Priority Data

Aug. 11, 1979 [DE] Fed. Rep. of Germany ..... 2932676

[51] Int. Cl.[3] ..... B01D 53/34

[52] U.S. Cl. ..... 423/210; 423/240; 423/241; 423/242; 423/244; 431/4; 431/10; 431/165; 431/352

[58] Field of Search ..... 423/210 R, 210 C, 240 R, 423/241, 242 A, 242 R, 244 A, 244 R; 431/3, 4, 10, 165, 352; 55/73, 71

[56] References Cited

U.S. PATENT DOCUMENTS

| | | | |
|---|---|---|---|
| 3,746,498 | 7/1973 | Stengel | 431/4 |
| 4,141,213 | 2/1979 | Ross | 431/352 |
| 4,235,585 | 11/1980 | Anderson | 431/4 |

*Primary Examiner*—Earl C. Thomas

*Attorney, Agent, or Firm*—Becker & Becker, Inc.

[57] ABSTRACT

A method of scrubbing reaction products resulting from flame burning of fuels containing impurities such as sulfur compounds, chlorine compounds, and fluorine compounds. The scrubbing is accomplished by the addition to the fire chamber of additives which bind the impurities. The additives are supplied to the burner flame by way of a gaseous and/or liquid carrier medium flow, accompanied by the formation of a veil surrounding the burner flame.

8 Claims, 1 Drawing Figure

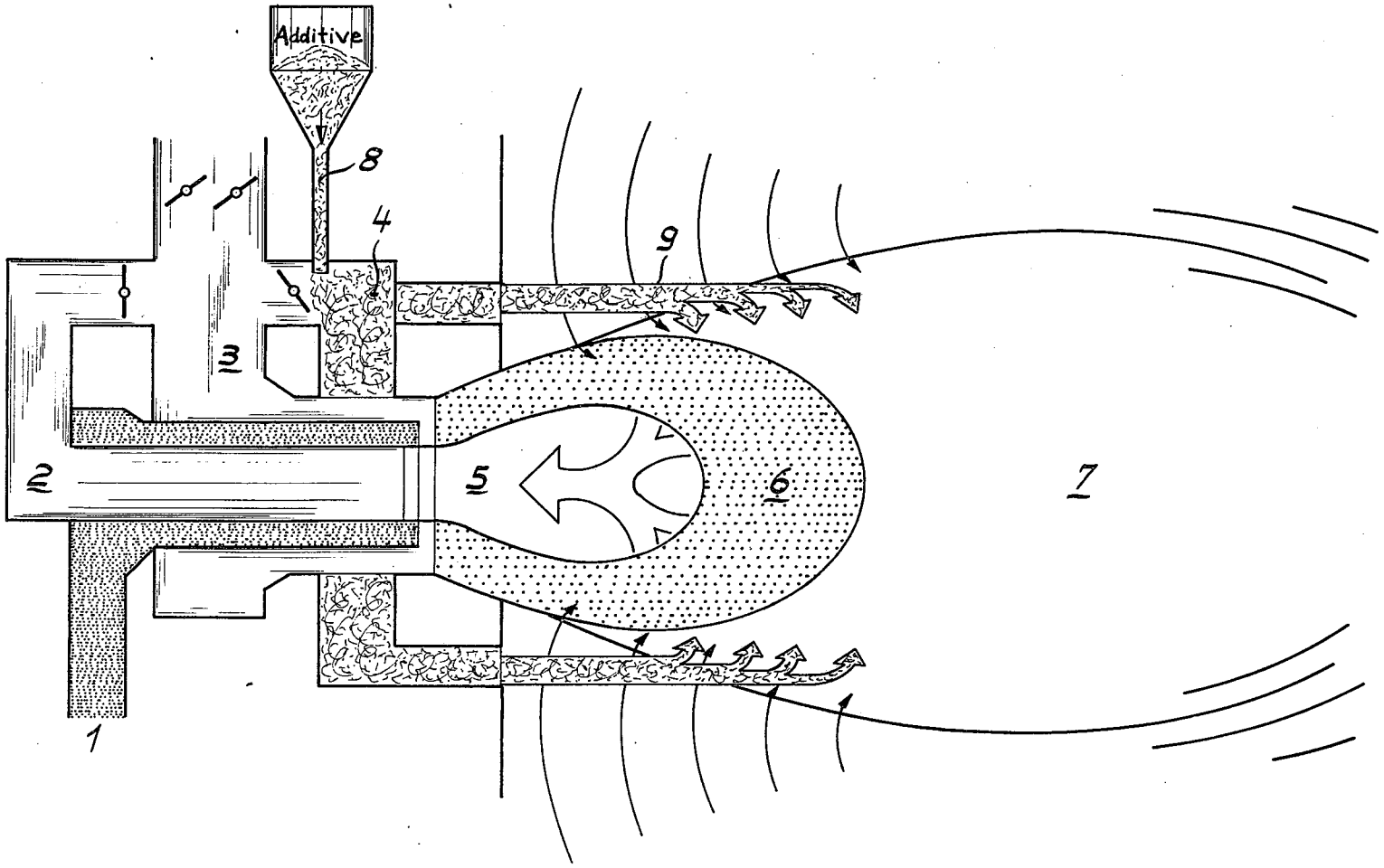
Additive
8
4
9
3
5
10
2
7
1

METHOD OF DRY SCRUBBING REACTION PRODUCTS RESULTING FROM FLAME BURNING

The present invention relates to a method of purifying or scrubbing reaction products which result from flame burning of fuels containing impurities such as sulfur compounds, chlorine compounds, and fluorine compounds; the scrubbing is accomplished by adding impurity-binding additives to the combustion chamber.

Methods are known for carrying out a dry scrubbing of reaction products arising from combustion of fuels containing impurities such as sulfur, chlorine, and fluorine. The additives binding the impurities are introduced in different ways into the combustion chamber.

With a first known method, the procedure is such that the additives are introduced into the combustion chamber above the flame region with the aid of air jets. The disadvantage of this known method consists in that the manner of introduction of the additives into the combustion chamber does not assure the binding of the impurities by the additives because the relatively low mixing energy of the air jets is not sufficient to attain a good mixing efficiency or degree of the reaction partners. Additionally, the mixing of the reaction partners takes place to a great extent in temperature ranges which do not guarantee optimum reaction conditions. Furthermore, the retention time available for completion of the reaction is insufficient, because the introduction of the additives generally occurs in inert unreactive regions.

With a second known method, the procedure is such that the additives are admixed to the fuel directly ahead of the introduction of the fuel into the burner. Disadvantageous with this method is that the additives are subjected to the entire temperature spectrum of the flame, whereby temperature ranges must be traversed which lead to an inactivation of the additives. This is especially true with fuels having a high heating value, which necessarily leads to flames having high temperatures.

It is therefore an object of the present invention to develop a method of the initially described type which assures that during addition of additives which bind impurities, these additives are combined with the reaction products from the combustion at a location and in a manner in the combustion chamber such that the conditions necessary for the binding in relation to temperature and mixing efficiency are attained.

This object, and other objects and advantages of the present invention, will appear more clearly from the following specification in connection with the accompanying drawing, which schematically illustrates a coal dust burner having features for practicing the method of the present invention.

The method of the present invention is characterized primarily in that the additives are added or introduced into the burner flame by means of a gaseous and/or liquid carrier medium flow accompanied by the formation of a veil or curtain surrounding the burner flame.

Different materials can be utilized as the carrier medium. According to a first embodiment of the present inventive method, combustion air in the form of a partial air flow can be used as the carrier medium.

According to the present invention there also exists the possibility to use a mixture of combustion air and flue gas as the carrier medium.

Another possibility is to use pure flue gas as the carrier medium.

An aqueous suspension also can be used as the carrier medium according to the method of the present invention.

Reactive metal oxides or hydroxides can be used as additives, such as the metal oxides and/or hydroxides of, for instance, the metals sodium, potassium, aluminum, barium, cadmium, calcium, copper, iron, lead, magnesium, manganese, and zinc.

Also usable in accordance with the present invention are additives in the form of pulverous materials, such as calcium carbonate, magnesium carbonate, and dolomite.

Since the location and manner of addition of the additives in the region of the flame utilizing a gaseous or liquid carrier medium flow are clearly prescribed, there is achieved that the reaction of the additives with the impurities from the combustion gases always occurs there where the reaction conditions exist at an optimum for the method involved.

Aside from establishing the location and manner for the addition of the additives, it is noted that the selection of the carrier medium for the reaction procedure can be influenced in a direction toward further optimization. This is true, for instance, if fuels with high flame temperatures can negatively influence the activity of the additives. Furthermore, by selection of the impulse flow of the carrier medium for the additives, the mixing procedure for the reaction partners can be controlled with respect to an optimizing of the reaction.

Referring now to the drawing in detail, the burner comprises a core-air pipe or tube 2, a fuel and coal dust carrier-air part 1, and a mantle-air part 3, and produces a primary combustion zone 6, the air number of which is between 0.8 to 1.1 times the stochiometry.

The burner is embodied in such a way that by means of specific measures (twist of the mantle air, conically widened burner opening or mouth, closed core air), in the interior of the flame there is generated a zone of intensive back flow 5 from a region of already advanced combustion. Consequently, the fuel-air mixture is quickly heated and ignited. The heating-up and ignition can be influenced by adjusting the core-air quantity.

The remaining combustion air is blown-in as the partial air flow 4 together with additives, which are to bind the gaseous materials arising during the combustion, by means of several jets or nozzles along the periphery in such a way that, around the flame, a mist, curtain or veil of partial air flow-additives forms, by means of which externally of the primary flame the secondary flame or the post-reaction zone 7 is formed and, by means of the partial air stream or flow, is supplied with oxygen and with additives which bind the impurities. The partial air flow 4 is arranged for this purpose in a partial circle, which corresponds to double or more of the diameter of the mantle-air pipe 3. This assures that the partial air flow 4 with the additives reaches the actual flame beyond the temperature ranges where the activity of the additives weakens, and downstream from the flow of the burner mouth, only after a distance of approximately one to two mantle-air pipe diameters. The addition of the additives to the partial air flow 4 occurs by means of a conduit 8, and in particular in the region of the partial air quantity regulating element, since a good intermixing is assured in this location because of the flow whirl which forms.

At those sections of the peripheral surface of the flame not adjoining the partial air flow 9, flue gases from the fire chamber are drawn in by impulse exchange. In this way, the flame temperature is reduced, which contributes to an advantageous influencing of the reaction between the additive and gaseous impurities.

In summary, the instant invention is directed to a method for generating a flame and scrubbing undesirable reaction products, such as sulfur, chlorine and fluorine compounds, from the flame. The method includes several simultaneous operations or steps. Referring to the drawing, a first stream of air is ejected from the pipe 2 to form an air core, while a stream of fuel is ejected from the carrier 1 which surrounds the pipe 2 to surround the air core with a stream of fuel. A second stream of air is ejected from the mantle 3 around the stream of fuel from the carrier 1 to form the primary combustion region 6, which region 6 surrounds the back flow region 5 in the air core. A carrier medium is ejected at the position 9 in radial spaced relation to the second air stream and downstream from both the air core and fuel stream to help form a post-reaction zone 7. Additives from the conduit 8 are entrained in the carrier medium and react with the undesirable reaction products in order to scrub the flame.

The present invention is, of course, in no way restricted to the specific disclosure of the specification and drawing, but also encompasses any modifications within the scope of the appended claims.

What I claim is:

1. A method of generating a flame while scrubbing undesirable reaction products including sulfur, chlorine and fluorine compounds from the flame, said method including the simultaneous steps of:

ejecting a first stream of air to form an air core;

ejecting a stream of fuel around the core of air and directly adjacent thereto;

ejecting a second stream of air around the stream of fuel and directly adjacent thereto;

ejecting a carrier medium outboard of and in spaced relation to the second stream of air and, said carrier medium being ejected toward the second stream of air and downstream from the ejection of the core air, fuel stream and second air stream;

igniting the fuel to form a back flow region within the air core; a primary combustion region around the back flow region and extending downstream therefrom, and a post reaction region around a portion of the primary combustion region and extending downstream of the primary combustion region, and entraining combustion product, binding additives in the carrier medium, which additives remaining in the post reaction region to bind with the undesirable reaction products and thereby scrub the flame at the source of the flame.

2. The method of claim 1 wherein the carrier medium includes air for combustion in the flame.

3. The method of claim 2 wherein the carrier medium further includes flue gas.

4. The method of claim 1 wherein the carrier medium is flue gas.

5. The method of claim 1 wherein the carrier medium includes an aqueous suspension.

6. The method of claim 1 wherein the additives are selected from the group consisting of reactive metal oxides and metal hydroxides.

7. The method of claim 1 wherein the additive is pulverized material.

8. The method of claim 7 wherein the pulverized material is selected from the group consisting of calcium carbonate, magnesium carbonate and dolomite.

* * * * *